United States Patent [19]

Castiglia

[11] 4,195,640

[45] * Apr. 1, 1980

[54] LOWER TORSO SUPPORT APPLIANCE

[76] Inventor: Ignatius F. Castiglia, 500 E. 77th St., New York, N.Y. 10021

[ * ] Notice: The portion of the term of this patent subsequent to Aug. 22, 1995, has been disclaimed.

[21] Appl. No.: 926,374

[22] Filed: Jul. 24, 1978

Related U.S. Application Data

[63] Continuation-in-part of Ser. No. 757,153, Jan. 6, 1977, Pat. No. 4,108,149.

[51] Int. Cl.[2] ..... A41C 1/08

[52] U.S. Cl. ..... 128/579 R

[58] Field of Search ..... 128/78, 559, 573, 579 R, 128/574

[56] References Cited

U.S. PATENT DOCUMENTS

| | | | |
|---|---|---|---|
| 1,379,101 | 5/1921 | Holt | 128/579 R |
| 2,265,662 | 12/1941 | Marshall | 128/579 R |
| 3,605,731 | 9/1971 | Tigges | 128/78 |
| 3,921,222 | 11/1975 | Hollman | 128/78 |

FOREIGN PATENT DOCUMENTS

| | | |
|---|---|---|
| 438751 | 11/1935 | United Kingdom . |
| 643607 | 9/1950 | United Kingdom . |
| 1072654 | 6/1967 | United Kingdom . |
| 1339798 | 12/1973 | United Kingdom . |

*Primary Examiner*—Werner H. Schroeder
*Assistant Examiner*—Doris L. Troutman
*Attorney, Agent, or Firm*—Frishauf, Holtz, Goodman & Woodward

[57] ABSTRACT

A fully adjustable lower torso support appliance which includes an elastic portion extending around the back of a wearer, and a removable inelastic front panel which is adjustably connected to the ends of the elastic member, the front panel being adapted to lie against the abdominal portion of the wearer. The front panel may be contoured to the general shape of the abdomen, and in some embodiments, to the abdominal shape of a pregnant woman. The elastic portion may carry a heat deformable, substantially rigid, back support member.

11 Claims, 12 Drawing Figures

LOWER TORSO SUPPORT APPLIANCE

CROSS-REFERENCE TO RELATED APPLICATION

This is a continuation-in-part of my prior application Ser. No. 757,153, filed Jan. 6, 1977 now U.S. Pat. No. 4,108,147.

BACKGROUND OF THE INVENTION

This invention relates to an orthopedic appliance, and more particularly to an abdominal support appliance.

It is the main object of the present invention to provide an abdominal support appliance which is fully adjustable, which exercises abdominal muscles, and which may also provide back support to the wearer.

It is a further object of the invention to provide such an appliance with a back support which is easily deformable, for example under heat, to precisely conform to the back contours of the wearer and which becomes substantially rigid, in its formed state, upon cooling.

SUMMARY OF THE INVENTION

In accordance with the present invention, a lower torso support appliance comprises an elastic beltlike section adapted to extend across a rear body portion of a wearer, generally in the vicinity of the waist of a wearer, the elastic section having respective free end portions; a completely separable inelastic front panel having opposing end portions; and means for adjustably connecting both of the opposing end portions of the front panel to the respective free end portions of the elastic section at a plurality of positions relative to the free end portions so that the front panel is substantially symmetrically locatable relative to the elastic section with the front panel overlying an abdominal portion of the body of a wearer and so that the appliance is adjustable to accommodate changes in size and/or shape of the abdominal area.

A substantially rigid sheet-like back support member may be provided in a pocket in the rear section of the belt-like member. In an alternative arrangement, a pocket need not be formed in the rear section of the belt-like member and the substantially rigid sheet-like member may be attached directly to the belt-like member by other means.

DETAILED DESCRIPTION

Figure 1:
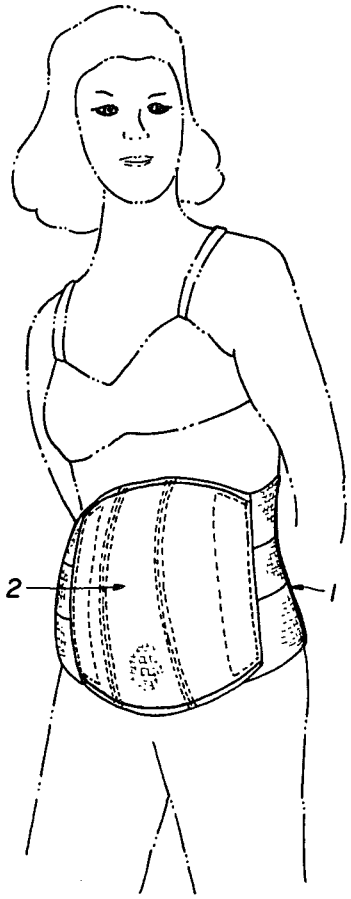
FIG. 1 is a front perspective view of the lower torso support device of the present invention in position on the body of a pregnant woman.
Figure 2:
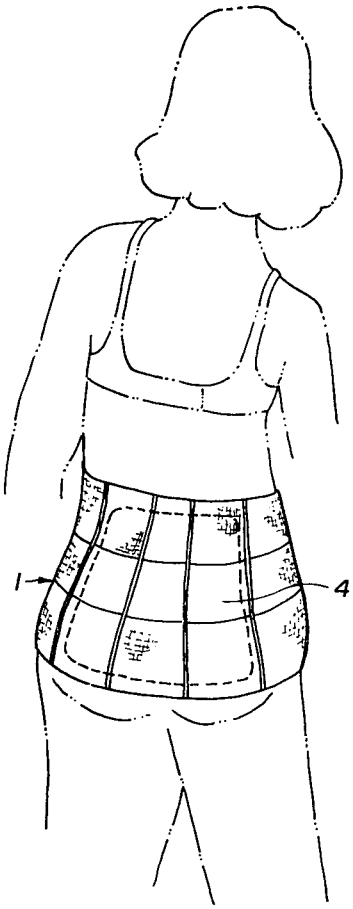
FIG. 2 is a rear perspective view of the device of FIG. 1, in use.

Referring to FIGS. 1 and 2, a lower torso support device, and particularly an abdominal support device for use as a maternity brace is shown on a pregnant woman. The appliance generally comprises an elastic belt member 1 which encompasses the rear and side body portions of the wearer, and a front panel 2 which is removably secured at both ends thereof to the elastic belt member 1. As better shown in FIG. 3, in one embodiment of the invention, the belt member 1 has a pocket 3 therein for removably receiving a substantially rigid member 4 of heat deformable material. The front panel is adapted to overlie at least a major portion of the abdominal area of a wearer. The elastic belt member 1 is located on the body of the wearer so that the substantially rigid member 4 is located adjacent the back of the wearer so as to provide support.

Figures 4, 5, 6, 7, 8, 9, 10A, 10B:
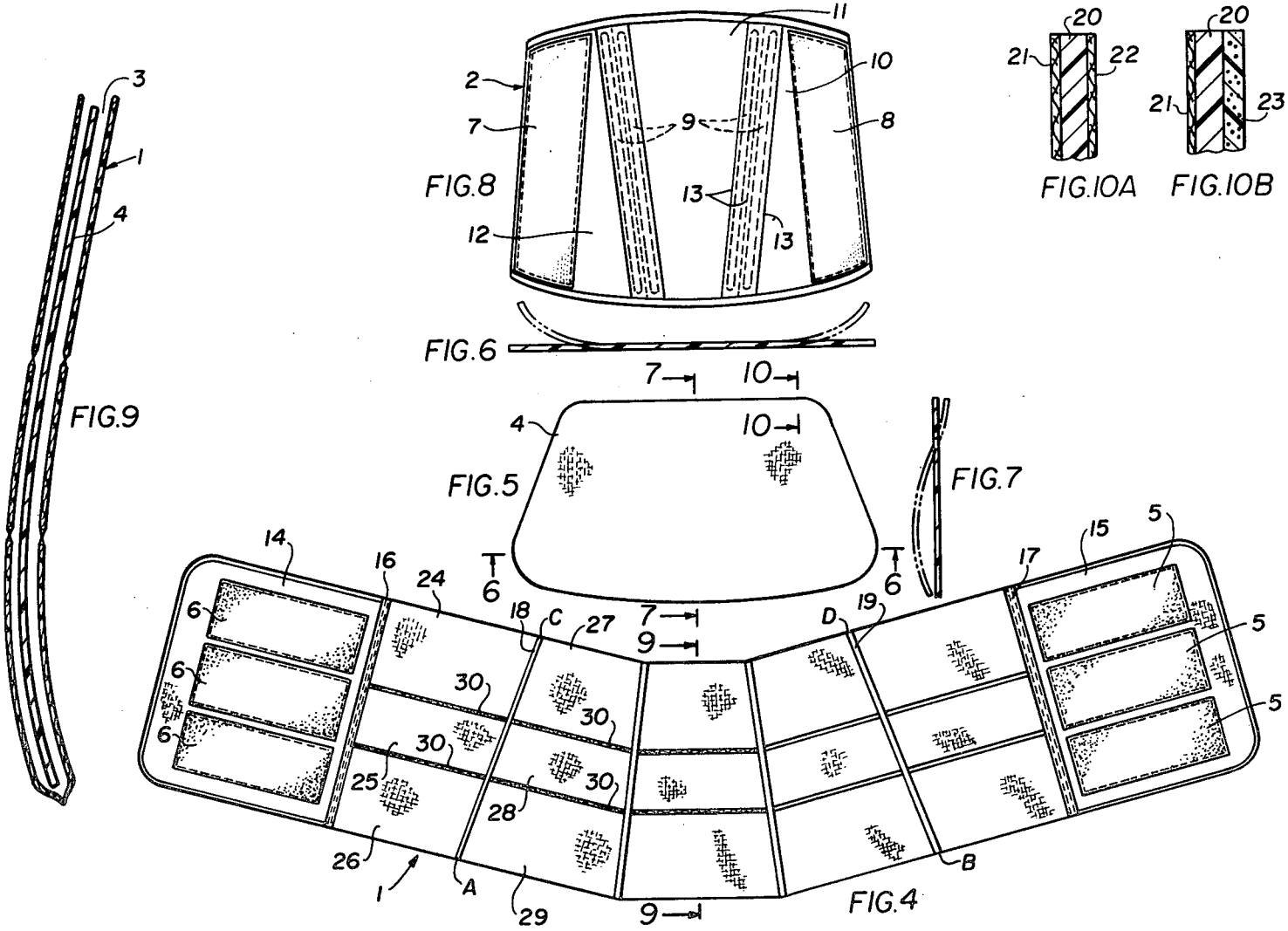
FIG. 4 is a flat view of the device of FIGS. 1-3 looking from the outer surface.
FIG. 5 illustrates a typical, molded back support panel for use in the present invention.
FIG. 6 is a cross-sectional view of the panel of FIG. 5, the panel being shown in its flat state in solid lines and in its contoured state in phantom lines.
FIG. 7 is a side cross-sectional view of the panel of FIG. 5, the panel being shown in its flat state in solid lines and in its contoured state in phantom lines.
FIG. 8 is a view, from the inside, of the removable abdomen panel.
FIG. 9 is a cross-sectional view of the device taken along the line 9—9 of FIG. 4, shown with the contoured panel in position in a pocket.
FIGS. 10A and B are enlarged partial cross-sectional views of respective typical moldable members for use as the back support section of the present invention.

The front portions of the belt 1 have contact-type fasteners, such as Velcro fasteners 5,6 for securing the front panel 2 to the belt 1. Other fasteners, preferably contact-type, can be used to provide secure but continuously adjustable fastening of the front panel 2 to the belt 1. As best seen in FIG. 8, the front panel 2 has Velcro fastening members 7,8 which removably attach to the Velcro members 5,6 of the belt 1 in an overlying manner. As should be apparent, the Velcro fasteners 7,8 relatively wide as are the Velcro fasteners 5,6 so that the front panel 2 may be secured to the belt member 1 at a continuously variable plurality of positions and orientations to accommodate for growth of the abdomen of a pregnant woman as pregnancy proceeds, or to accommodate different size and shape abdomens on non-pregnant users of the appliance. This enables the size of the device to be readily expanded, while also providing proper back support and proper abdomen support. Since the front panel 2 is completely seperable, the size of the device can be adjusted in a symmetrical manner so that the various support members are always properly oriented relative to the body of the wearer, regardless of the size and shape of the wearer. Further, the contact-type fasteners substantially prevent horizontal and vertical relative movement between the belt member 1 and the front panel 2 in the areas of contact. This permits an exercising effect to be applied to the abdominal muscles by the appliance.

The front panel 2 further includes substantially rigid elongated stays 9 for preventing buckling of the front panel 2 and for providing additional support to the wearer. The stays 9 may be secured to the front panel by means of stitching, adhesives, or may be located in respective pockets stitched to the removable panel 2 (as in FIG. 8).

Figure 3:
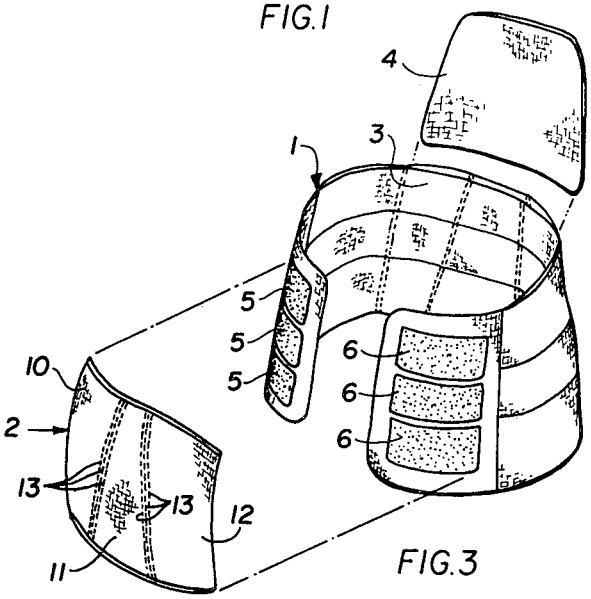
FIG. 3 is an exploded perspective view of the device of FIGS. 1 and 2 showing the relative positions of the three major components thereof, with the back support member removed from its pocket.

The front panel 2 is preferably made of a substantially rigid non-elastic fabric, and is preferably formed so as to have an outwardly curved contour, as shown in FIG. 3. The contour may be readily obtained by fabricating the front panel 2 from, for example, three separate pieces of material 10, 11, 12 stitched together, for example by seams 13. Pockets may be formed by seams 13 in which the stays 9 are received. The outward contour of the front panel 2 provides better conformance with the contour of the abdomen, especially of a pregnant woman, and enhances the performance of the appliance.

As best seen in FIGS. 4 and 9, the belt 1 perferably has a pocket 3 (see FIG. 9) formed therein for receiving the substantially rigid, heat-deformable member 4. The bottom closed portion of the pocket 3 extends between points A and B as shown in FIG. 4. The open top portion of the pocket 3 extends between points C and D as shown in FIG. 4. The belt 1 is preferably fabricated completely of elastic material, except for the inelastic end portions 14 and 15, which are secured to the elastic main portion, for example by respective seams 16 and 17. The pocket 3 may be defined by seams 18 and 19 formed in either a continuous piece of elastic material, or formed when connecting individual pieces of elastic material together, for example as shown in FIG. 4. The seams connecting individual pieces of elastic material together for the portions of the belt which overlie the pocket are formed in only the respective opposing pieces, so as to form a hollow pocket 3 for receiving the member 4. The belt is, in its flat state, generally slightly "V-shaped", so as to provide a better fit around the waist area of a wearer, and particularly around the waist area of a pregnant woman. An overlay of fabric or elastic may be secured to the belt, for example by stitching, to cover the seams between the various belt portions. If desired, stays, or the like, could be located in the vicinity of the various seams 16–19. The pocket 3 may be seamed closed after insertion of member 4 therein.

The above-described device provides less than total immobilization, but yet substantially restricts natural body movements to a degree which still permits the wearer to be ambulatory.

The substantially rigid member 4 which is removably inserted into the pocket 3 is preferably of a plastic heat-deformable material such as, for example, the plastic sheet material alone or covered as disclosed in U.S. Pat. No. 3,906,943, the entire contents of which are incorporated herein by reference. The insert 4 is heat formed to conform to the body portion of the wearer against which it is to be adjacent as disclosed in said U.S. Pat. No. 3,906,943. Other suitable materials can also be used to form the removable member 4. FIGS. 6 and 7 show typical examples of how a heat-deformable member 4 is formed to conform to a body portion, such as the back of a wearer.

In FIGS. 10A and 10B, there are shown typical material configurations from which the heat-deformable member 4 may be fabricated. The heat-deformable members 4 are preferably of a plastic heat-deformable material 20 with fabric layers 21,22 on opposite sides thereof as disclosed in said U.S. Pat. No. 3,906,943. One of the fabric layers 21,22, which are securely adhered to the plastic layer 14, is preferably of an insulating material to prevent heat from the heated-up insert from being uncomfortably transmitted to the body of the wearer when the insert is being formed to conform to the body contour of the wearer.

As shown in FIG. 10B, the plastic material 14 may be provided with a foam layer 23 to replace one of the fabric layers. In use, the foam layer 23 is directed toward the body of the wearer to provide additional cushioning to provide impact absorption characteristics to the device and to generally make the device more comfortable in normal use. The foam layer 23 also acts as the insulating layer when conforming the heated-up member 4 to the body contours of the wearer. A foam-covered plastic member is disclosed, for example, in U.S. Pat. No. 2,800,129.

By virtue of the pocket 3 being generally trapezoidal in shape (as shown in FIGS. 2, 3 and 4), the removable member 4 is securely retained in the belt 1. In order to insert the member 4 in the pocket 3, it is only necessary to stretch the elastic material of the belt so as to spread apart points C and D (FIG. 4) to permit the member 4 to enter into the pocket 3. When the belt is relaxed, the points C and D move again toward each other to positively retain the member 4 in place. As mentioned hereinabove, the member 4 may be made non-removable from belt 1 by seaming the pocket 3 closed after insertion of member 4 therein. The member 4 may be formed to the body by heating and shaping while it is in the pocket 3 of the belt 1.

The member 4 may be secured in the belt 1 by, for example, sewing it in the belt 1. The member 4 may be adhered to a portion of the belt 1, may form an inelastic section of the belt 1, or an inelastic flexible member may form a rear part of the belt 1, as desired. In these constructions, the belt 1 is still considered to be "substantially elastic" as referred to in the claims.

Figure 11:
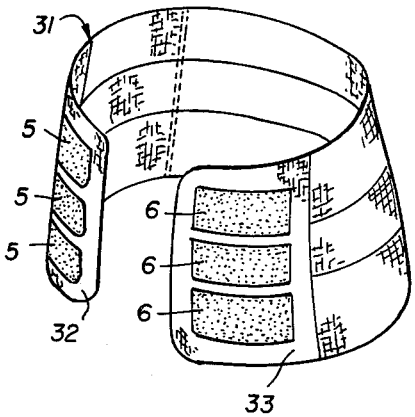
FIG. 11 is a perspective view of a modified device not having a back support member.

FIG. 11 illustrates a modified elastic belt section 31 which has no pocket for receiving a back support member 4 and which does not include any substantially rigid back support member whatsoever. The part of the rear belt member 31 between ends 32,33 is made from elastic material. End portions 32,33 are inelastic materials having contact-type fasteners 5,6 secured thereon, as in the embodiment of FIGS. 3 and 4. The elastic rear portion of belt 31 may be made from one piece of elastic, or several pieces stitched together as illustrated in FIG. 11. The embodiment of FIG. 11 is useful in instances where no back support is needed, or where it is not necessary to secure the back support to the elastic belt section.

In use, it has been found that the lower torso support appliances according to the present invention not only provide desirable abdominal support characteristics for weakened abdominal muscles or where abdominal muscles need reinforcement, but also apply a muscle exercising effect which exercises and tones abdominal muscles and provides similar effects as in convention exercise. These effects may be obtained with or without the substantially rigid back support member 4. With the back support member 4 in place, the muscle exercising and toning effect is improved, and the appliance exhibits further improved effects in that back problems may be alleviated and/or prevented. This is due to the reciprocal effect between back support member 4 and inelastic front panel 2, which are cooperatively coupled together via elastic belt 1 in a secure fashion with the Velcro fasteners. This construction not only provides a better abdominal support but also provides a better back support device, due to the interaction between the various components thereof.

The belt 1 is preferably made of a plurality of elastic panels, such as panels 24–29 (FIG. 4) which are sewn together to form the composite elastic belt structure. The generally horizontal seams 30 are preferably loose seams which permit limited relative movement between adjacent panels 24–25, 25–26, etc. The generally vertically oriented seams are preferably tight seams which do not permit such relative movement. While the portion of the belt 1 between seams 16 and 17 is shown as being completely elastic, alterations could be made by interposing sections of inelastic material. However, such an alternative construction would be less advantageous than the construction illustrated in the Figures. The precise shape of the heat-deformable member 4 may be varied, as suits the particular requirements.

Various other modifications and alterations could be made, as will be apparent to those skilled in the art, within the spirit and scope of the accompanying claims.

I claim:

1. A lower torso support appliance, comprising:

a substantially elastic belt-like section having respective free end portions, said elastic section being adapted to extend across a rear body portion of a wearer, and to extend from an upper level in the vicinity of the upper part of the abdomen to a lower level in the vicinity of the lower part of the abdomen of a wearer;

a completely separable inelastic front panel having opposing end portions and dimensioned to overlie and bear against at least a major portion of the abdomen of a wearer; and contact-type connecting means including contact-type engagement areas at said opposing end portions of said inelastic front panel and at the free end portions of said substantially elastic belt-like section for continuously, adjustably, and fixedly connecting each of said opposing end portions of said inelastic front panel to a respective free end portion of said substantially elastic belt-like section at a continuously variable plurality of positions relative to said free end portions with said end portions of said inelastic front panel always in overlying contact with their respective free end portion of said substantially elastic belt-like section to substantially prevent horizontal and vertical relative movement therebetween at the contact areas so that said inelastic front panel is substantially symmetrically locatable relative to said substantially elastic belt-like section at a plurality of orientations with said inelastic front panel overlying and elastically biased against at least a major portion of the abdominal area of the body of a wearer and so that said appliance is continuously adjustable to different sizes and different orientations of said front panel to accommodate different size and shape abdominal areas and variations in size of the abdominal area.

2. The appliance of claim 1 wherein said elastic belt-like section has respective substantially inelastic end portions, said substantially inelastic end portions carrying at least a portion of said adjustable connecting means for adjustably connecting said front panel to said elastic belt-like section.

3. The appliance of claim 2 wherein said adjustable connecting means comprises loop pile fasteners formed of interengageable male hook and female loop portions, one of said male and female portions being carried by said substantially non-elastic end members of said belt-like section and the other of said male and female sections being carried by said opposing end portions of said front panel.

4. The appliance of claim 1 wherein said adjustable connecting means comprises loop pile fasteners formed of interengageable male hook and female loop portions, one of said male and female portions being carried by free end portions of said belt-like section and the other of said male and female sections being carried by said opposing end portions of said front panel.

5. The appliance of any of claims 1–4 wherein said separable front panel is contoured generally in the shape of the abdomen of a wearer.

6. The appliance of claim 1 further comprising a substantially rigid sheet-like member carried by said substantially elastic belt-like section for engagement against a predetermined portion of the body of the wearer in the vicinity of the lower back of the wearer.

7. The appliance of claim 6 wherein said substantially rigid sheet-like member is carried by said substantially elastic belt-like section in a substantially central portion of said substantially elastic belt-like section.

8. The appliance of claim 6 wherein said belt-like section includes means forming a pocket therein for receiving said substantially rigid sheet-like member.

9. The appliance of claim 8 wherein said means forming a pocket has an opening therein for removably receiving said substantially rigid sheet-like member therein.

10. The appliance of claim 6 wherein said substantially rigid sheet-like member is heat deformable and is moldable, in the heated condition, to conform to the contours of the body portion of a wearer in the vicinity of the lower back of the wearer, and substantially retains its contour-molded condition upon cooling.

11. The appliance of claims 1 or 6 wherein said front panel comprises at least one substantially rigid stay member extending substantially transversely thereof.

* * * * *